United States Patent [19]

Bush

[11] Patent Number: 4,511,032

[45] Date of Patent: Apr. 16, 1985

[54] CHILD RESISTANT SAFETY CONTAINER

[75] Inventor: Randall G. Bush, Evansville, Ind.

[73] Assignee: Sunbeam Plastics Corporation, Evansville, Ind.

[21] Appl. No.: 488,231

[22] Filed: Apr. 25, 1983

[51] Int. Cl.[3] ..... B65D 43/10; B65D 85/56

[52] U.S. Cl. ..... 206/1.5; 206/531; 220/332

[58] Field of Search ..... 206/528–540, 206/1.5; 220/291, 292, 315, 324, 326, 329, 331–337, 339

[56] References Cited

U.S. PATENT DOCUMENTS

| | | | |
|---|---|---|---|
| 2,086,534 | 7/1937 | Byrne | 220/331 |
| 2,124,298 | 7/1938 | Hiering | 150/42 |
| 2,601,101 | 6/1952 | Derham | 220/324 |
| 3,013,656 | 12/1961 | Murphy, Jr. | 206/572 |
| 3,165,225 | 1/1965 | Reitzel | 220/331 |
| 3,324,996 | 6/1967 | Jordt | 220/339 |
| 3,504,788 | 4/1970 | Gray | 206/531 |
| 3,579,883 | 5/1971 | Hayes | 206/534 |
| 3,972,416 | 8/1976 | Underwood | 206/1.5 |

FOREIGN PATENT DOCUMENTS

| | | | |
|---|---|---|---|
| 116711 | of 1930 | Fed. Rep. of Germany | 220/331 |
| 498656 | 1/1939 | United Kingdom | 220/332 |
| 533590 | 2/1941 | United Kingdom | 220/291 |

*Primary Examiner*—George E. Lowrance
*Assistant Examiner*—Jimmy G. Foster
*Attorney, Agent, or Firm*—Fisher, Crampton, Groh & McGuire

[57] ABSTRACT

A child resistant, safety container molded of plastic material as a single unit which includes a pair of tray members joined together by a pliable hinge requiring two dissimilar movements of the tray members relative to each other to open the container, such movements requiring twisting of the tray members relative to each other and subsequent swinging movement of the tray members to an open position.

15 Claims, 4 Drawing Figures

CHILD RESISTANT SAFETY CONTAINER

This invention relates to child-resistant containers and particularly to containers for packaging capsules or pills.

It is desirable to provide packaging for pills and capsules which is child-resistant and, if possible, also tamper indicating. Many child-resistant packages rely on the principle that an adult is stronger than a child and can apply greater opening force to a package. Unfortunately, such child-resistant packages often are very difficult for adults to use as well. For example, blister packaged pills and capsules in which the pills or capsules are individually covered by a thin sheet of plastic offer an effective tamper-indicating package results but when an effort is made to incorporate child resistant features requiring force, the child-resistant features make the package difficult and frustrating for even adults to use.

It is an object of the invention to provide a child-resistant package in which excessive force is not required to perform the opening function.

Another object of the invention is to provide a child-resistant package in which two dissimilar motions must be performed sequentially to afford opening.

Still another object of the invention is to provide packaging for pills or capsules which can be used with blister packaging techniques to afford tamper-indicating and at the same time provides child-resistant features not requiring excessive force to gain access to the pills or capsules.

The invention is embodied in a one piece plastic container in which a pair of container or tray members are formed, one of which acts as a receptacle and the other a cover with the tray members having identical perimeters engageable with each other when the members are in a closed condition. The members are joined together by a flexible and pliable hinge portion that permits the members to swing from an open to a closed position where the members become latched to each other to prevent reverse movement in an opening direction. A latch arrangement is provided which requires twisting the members relative to each other a predetermined amount while their perimeters remain in engagement so that complementary latch portions become disengaged to permit movement of the members to an open position relative to each other.

A preferred embodiment of the invention is illustrated in the drawings in which.

Figure 1:
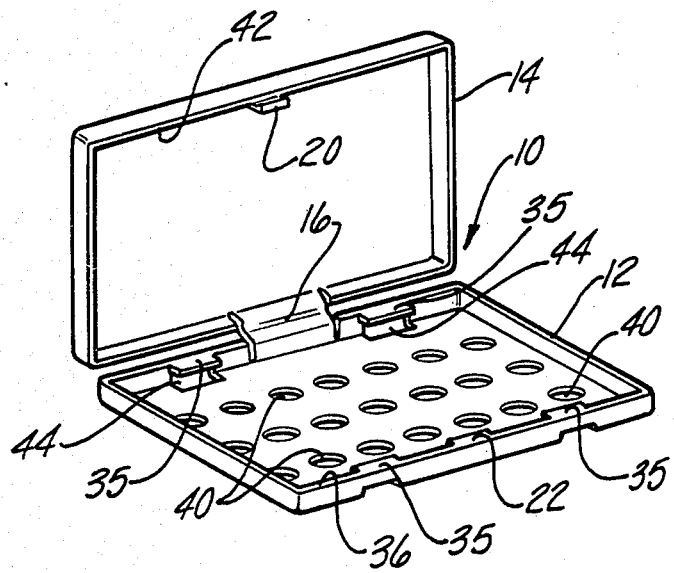
FIG. 1 is a perspective view of a child resistant container embodying the invention shown in its open position.

A child-resistant container embodying the invention is designated generally at 10 and includes a pair of tray members 12 and 14 joined together by a living hinge 16. The members 12, 14 and hinge 16 are molded as a unit in an open position from such material as polypropylene or other plastic materials.

The tray member 12 forms a compartment for holding pills or capsules and the tray member 14 forms a cover. The member 12 and 14 have substantially identical perimeters so that in the closed condition of the package 10, the perimeters are congruent and afford a smooth surface which resists gripping to prevent forcing the package 10 to an open position.

Figure 2:
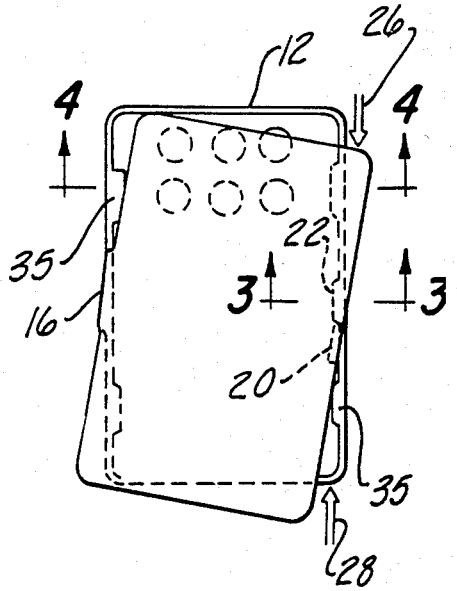
FIG. 2 is a top view of the container seen in FIG. 1 in a partially open position.
Figure 3:
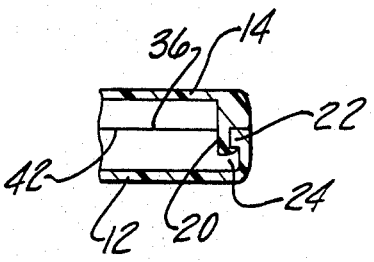
FIG. 3 is a cross sectional view on line 3—3 in FIG. 2 when the container is in a closed position.

The living hinge 16 operates normally to swing the two trays into adjacent alignment in which case the members 12 and 14 swing about an axis parallel to the adjacent edges of the trays 12 and 14. The living hinge 16 also is sufficiently pliable and resilient to twist upon displacement of the tray members 12 and 14 relative to each other while they remain in adjacent relationship as illustrated in FIG. 2.

The tray members 12 and 14 are maintained in closed position relative to each other by latch means which includes a hook element 20 formed on one of the tray members 14 and a complementary tab 22 formed on the other of the tray members 12. The hook element 20 has a cam surface 24 so that upon closing movement of the tray member 14 from the position in FIG. 1 relative to the tray member 12, the cam surface 24 engages the tab 22 to deflect the elements 20 and 22 relative to each other until the hook element 20 engages the underside of the tab element 22. In that position, opening movement about the normal axis of the container is prevented.

With the container 10 in its closed position with the two tray members 12 and 14 in adjacent relationship to each other, the hook element 20 will be engaged with the underside of the tab element 22 to prevent the usual hinging movement. To release the hook element 20 from the tab element 22, the tray member 12 and tray member 14 are twisted relative to each other by applying force to the tray members in opposite directions as indicated by the arrows 26 and 28 seen in FIG. 2. This twists the tray members 12 and 14 about the flexible hinge 16 for a predetermined distance causing the hook element 20 to disengage from the tab element 22. Thereafter, the members 12 and 14 will overlap each other as viewed in FIG. 2 so that the tray member 14 can be lifted relative to the tray member 12 to the open position illustrated in FIG. 1. Thus, two dissimilar motions are required; namely, twisting the members 12 and 14 relative to each other followed by swinging movement about the normal axis of the hinge 18 to bring about the opening condition. Both of these movements are required to result in opening. If, for example, the tray members 12 and 14 are twisted relative to each other but are released without hinging movement toward an open position, the resiliency of the hinge 16 will cause the tray members 12 and 14 to resume their normal closed condition in which the hook element 20 is engaged with the tab element 22. Also in that condition, the perimeters of the tray member 12 and 14 will be congruous and will not afford any edges by which lifting or separation of the members 12 and 14 can be accomplished. This then results in a child-proof package or container 10.

Figure 4:
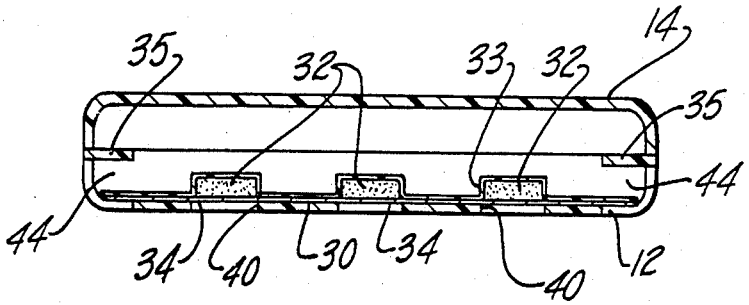
FIG. 4 is a cross sectional view taken generally on line 4—4 when the container is in its closed position.

The benefits of tamper indicating provided by blister packaging can be accomplished with the container 10 by inserting a card 30 (FIG. 4) having pills or capsules 32 covered by a blister of plastic film 33. In such packaging, a clear plastic film is draped over uniformly distributed pills or capsules 32 to conform to their shape. Removal of pills or capsules 32 typically is accomplished by pushing on the film 33 above a selected pill or capsule to push it through an opening 34 formed in the card 30 and covered by foil or by tearing the plastic blister. In either event, the absence of the pill or tearing of the blister gives evidence of tampering.

In the present instance, the card 30 has an outer perimeter conforming generally to the inside perimeter of the tray member 12 to aid in accurately positioning the card 30 within the tray member. The tray member 12 also is provided with protrusions or tabs 35 formed adjacent the upper lip 36 of the tray member 12. The tabs 35 overlie the card 30 and serve to retain it in position relative to the tray member 12. The bottom of the tray member 12 can be provided with a plurality of openings 40 which align with the capsules or pills on the card 30 to facilitate removal of a pill or capsule from both the card 30 and the tray 12. Removal is accomplished by opening the container 10 and pressing on the selected one of the pills or capsules to push it through not only the card 30 but also the associated opening 40 in the bottom of the container 10.

When used in this manner the container 10 gives both child resistant and tamper indicating features. The child resistant features are afforded by the coacting tray members 12 and 14 and the tamper indicating features are provided by the blister packaged pills on card 30.

The tabs 35 which retain the card 30 in tray member 12 extend from the upper lip 36 of tray member 12 and engage a portion of the corresponding lip 42 of tray member 14 when the container 10 is in its fully twisted and unlatching relationship as illustrated in FIG. 2. The openings 44 in tray member 12 which underlie the tabs 34 are for the purpose of facilitating molding.

It will be understood that although the container 10 illustrated and described has a generally rectilinear configuration that a variety of other shapes also are possible provided that the perimeters are the same so that in a closed condition of the container ledges or edges are not available to facilitate opening by prying or otherwise forcing the members apart.

A safety container of the child resistant type has been provided in which a unitary, one piece container is made of plastic material and requires two dissimilar motions to move the relatively hinged tray members from a closed to an open position. The container is particularly adapted for holding pills or capsules which have been packaged on a card by the blister packaging technique so that the safety container offers not only child resistant features but tamper indicating features afforded by blister packaging.

The embodiments of the invention in which an exclusive property or privilege is claimed are defined as follows:

1. A child resistant safety container comprising: a receptacle having a predetermined perimeter, a cover member having a mating perimeter to said predetermined perimeter, a pliable living hinge means holding said cover on said receptacle for pivotal movement between closed and opened positions about a first axis and permitting limited movement of said receptacle and cover about a second axis transverse to said first axis, said receptacle, said cover member and said hinge means being formed as a single unit, and latch means concealed within said container and holding said cover member in closed position relative to said receptacle, said latch means including a hook member having a cam surface for cooperatively engaging a tab formed integrally with said receptacle whereby closing of the container by relative movement of the cover and the receptacle about said first axis causes the cam surface to engage said tab means and push the tab means and latch means away from each other until said hook portion engages the underside of said tab portion with a distinctive sound alerting the operator that the container is closed properly, said cover being releasable from said closed position upon sequential relative twisting movement of said receptacle and cover about said second axis of said hinge means to a position in which said perimeters of said cover member and receptacle are misaligned and overlap each other to permit subsequent lifting of said cover member to an open position, and said cover being engageable with said receptacle in a closed position upon simple pivotal movement of said cover relative to said receptacle about said first axis.

2. The safety container of claim 1 wherein said mating perimeters of said receptacle and cover resist gripping for movement of said cover member relative to said container about said first axis.

3. The safety container of claim 1 wherein said receptacle contains a card member with a product covered by a transparent layer of plastic, said receptacle having a plurality of inwardly extending tabs to hold said card within said receptacle when cover is in said open position.

4. The safety container of claim 1 wherein said receptacle has an inside perimeter of a predetermined shape, a card having a perimeter conforming to that of the receptacle disposed within said receptacle, said receptacle having a plurality of inwardly extending tabs above the bottom of said receptacle to retain said card in position.

5. The safety container of claim 4 wherein said tabs are at the same level as the upper edge of said compartment and form a supporting surface of the edge of said cover during twisting movement to disengage said latch.

6. The safety container of claim 1 wherein said latch means permits closing of said container upon movement of said cover about said first axis relative to said compartment.

7. The safety container of claim 1 wherein said hinge means is made of yieldable material and yields upon exerting a force to said cover and compartment in opposite directions while the container is closed and the perimeters of said lip and compartment remain in substantially the same plane therebetween.

8. The safety container of claim 7 wherein said hinge means acts to return said cover and compartment to a latched position upon release of the force acting in opposite directions on said cover and said compartment.

9. A child resistant safety container comprising: a pair of container members having perimeters engageable and aligned with each other when said members are in a closed condition, pliable living hinge means joining said members together and forming therewith a one piece structure, said hinge means being made of flexible material to permit swinging movement of said members relative to each other between open and closed positions, latch means engageable as said members swing to a closed position from an open position to positively prevent reverse movement, said latch means including a hook member having a cam surface for cooperatively engaging a tab carried upon said receptacle whereby during closing of the container by downward thrust of the cover relative to the receptacle, the cam surface on the latch means engages the conventional tab means, and pushes the tab means away from each other until the hook portion of the latch means engages the underside of the tab portion with a distinctive sound thereby alerting the operator the container is closed properly, said closing action being accomplished with a pivotal action of said cover relative to said receptacle about said pliable living hinge means, said latch means having a predetermined width and being releasable upon sequential twisting of said members relative to each other about said hinge means a distance greater than said predetermined width of said latch means while said perimeters of said members remain in the same plane relative to each other to permit subsequent relative swinging movement of said members to an open position.

10. The container of claim 9 wherein said latch means are returnable to said latched position upon release of said members from a relatively twisted condition in which said latch means are unlatched.

11. The container of claim 9 wherein said members can be twisted in opposite directions relative to each other.

12. The container of claim 9 wherein said latch means are concealed within said members when said members are in a closed condition.

13. The container of claim 9 wherein said perimeters of said members are congruent to each other in a closed position and are shaped to resist gripping for movement of said members in an opening direction.

14. The container of claim 9 wherein said latch means includes a hook formed on one of said members and a complementary hook receiving ledge on the other of said members.

15. The container of claim 14 wherein said hook and hook receiving member are disposed at the perimeter of said members opposite to said hinge means.

* * * * *